United States Patent [19]

Berardi et al.

[11] 4,121,492

[45] Oct. 24, 1978

[54] REINFORCED NECK FOR STRINGED MUSICAL INSTRUMENTS

[76] Inventors: Dennis A. Berardi, 38 Rogers Ave., Manasquan, N.J. 08736; Phillip J. Petillo, 1206 Herbert Ave., Ocean, N.J. 07712

[21] Appl. No.: 705,552

[22] Filed: Jul. 15, 1976

[51] Int. Cl.[2] ..... G10D 3/00

[52] U.S. Cl. ..... 84/293

[58] Field of Search ..... 84/293, 267, 291, 269

[56] References Cited

U.S. PATENT DOCUMENTS

| | | | |
|---|---|---|---|
| 1,596,763 | 8/1926 | Place, Jr. | 84/293 |
| 2,101,364 | 12/1937 | Dopyera | 84/293 |
| 2,469,582 | 5/1949 | Strong | 84/293 |
| 3,911,778 | 10/1975 | Martin | 84/293 |
| 3,915,049 | 10/1975 | Bean | 84/293 |

*Primary Examiner*—Stephen J. Tomsky

*Attorney, Agent, or Firm*—Lerner, David, Littenberg & Samuel

[57] ABSTRACT

A stringed musical instrument has a composite neck and head structure comprising an elongated reinforcing member having a T-shaped cross-sectional area extending throughout the length of the instrument neck and terminating in a forked head. The generally semicircular cross-sectional configuration of the neck is achieved by the addition of a top lamination and side inserts of materials which produce the desired feel and appearance.

2 Claims, 6 Drawing Figures

TUNING PEG
NUT
NECK
FINGERBOARD
HEAD
FRET
PICKUP
CONTROLS
BRIDGE
BODY 1
3
5
6
7
9
11
13
15
17
19
20
21

REINFORCED NECK FOR STRINGED MUSICAL INSTRUMENTS

BACKGROUND OF THE INVENTION

Stringed instruments may be divided generally into two catagories — bowed and plucked. The violin is an example of a stringed instrument in which the vibrations of the strings to produce musical sounds are initiated by rubbing the strings with a bow. The guitar is an example of a stringed instrument in which the vibrations of the strings to produce musical sounds are initiated by plucking the strings with the fingers or with a plectrum. In each of the examples given the strings of the instrument are stretched tightly along the body and neck with varying tensile forces of great magnitude. The neck structure in particular is subjected to forces tending to warp and twist it from its original shape.

The musical notes produced by stringed instruments in which the strings are stretched along the neck member are varied by pressing the strings against the neck with the fingers to change the length of the vibrating strings. In order to play the instrument with reasonable facility the strings must be accurately spaced from the neck in uniform fashion. Any twisting or warping of the neck member disrupts this uniformity of spacing and usually results in difficulty in holding the strings properly against the neck, or, in the case of a fretted neck, an undesirable buzzing sound produced by the strings vibrating against the frets. The undesirable twisting or warping may result from the tensile force produced by the stretched strings alone, or, in the case of wooden instruments, changes in temperature and humidity may contribute to the distortion.

The problem of providing reinforcement for the necks of stringed instruments is not new and has been met with varying degrees of success. It has been proposed in the past to employ a steel shaft as a truss rod within a wooden neck. In U.S. Pat. No. 1,652,627 to Jerome it was proposed to make the entire frame of the instrument in a unitary casting of metal, preferably aluminum, possessing rigidity, strength, resonance and lightness. In U.S. Pat. No. 3,915,049 to Bean it was proposed to make the neck of the instrument of extruded aluminum with at least one groove running the length thereof to improve the efficiency of sound transfer to the soundboard. The use of exposed metal surfaces on portions of the neck which are touched by the hand or fingers of the player is not desirable. If the metal is aluminum a black oxide will be formed and will rub off on the hand of the player. Furthermore, a player accustomed to the warm feel of wood will not readily accept a metallic substitute.

SUMMARY OF THE INVENTION

The present invention relates to a reinforced neck for stringed musical instruments in which warpage, twisting and other geometrical distortion is eliminated by the use of a T-shaped reinforcing member which supplies structural rigidity to the neck while preserving the desirable feel and appearance of wood or plastic materials. The neck has a T-shaped member extending the length thereof. A wooden lamination on the top of the T-shaped member serves as the fingerboard and the sides of the T are filled with wooden or plastic material to complete the conventional semicircular cross-sectional configuration. The head is formed unitary with the reinforcing neck member and is a forked structure which eliminates unnecessary material and undesirable weight.

DESCRIPTION OF THE DRAWINGS

The invention will be understood more readily by making reference to the drawings in which FIG. 1 is a view of a conventional electric guitar embodying the reinforced neck and head structure of the invention. The invention has particular application to guitars, which are fretted instruments, but it will be appreciated that violins, violas, cellos, and other stringed instruments with plain fingerboards may employ the inventive features with equally improved results.

Figures 1, 5, 6:
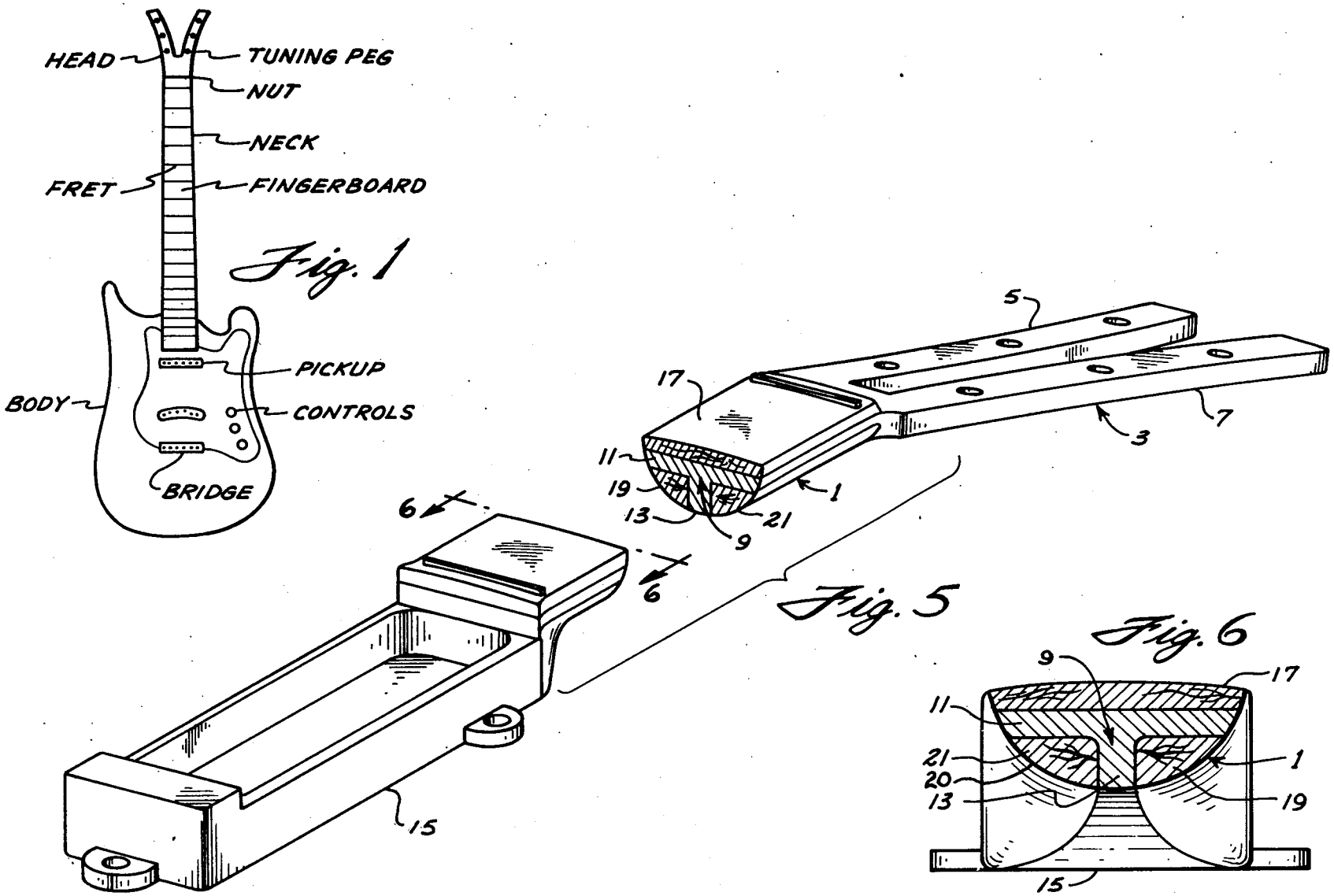
FIG. 1 is a top plan view of a conventional electric guitar embodying the reinforced neck and head structure of the invention.
FIG. 5 is a perspective view of the structure.
FIG. 6 is a cross-sectional view taken along line 6—6 of FIG. 4.
Figure 2:
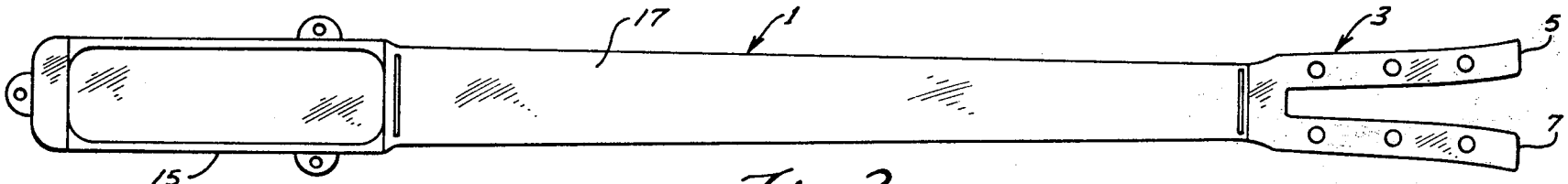
FIG. 2 is a top plan view of the neck and head structure embodying the features of the invention.
Figure 3:
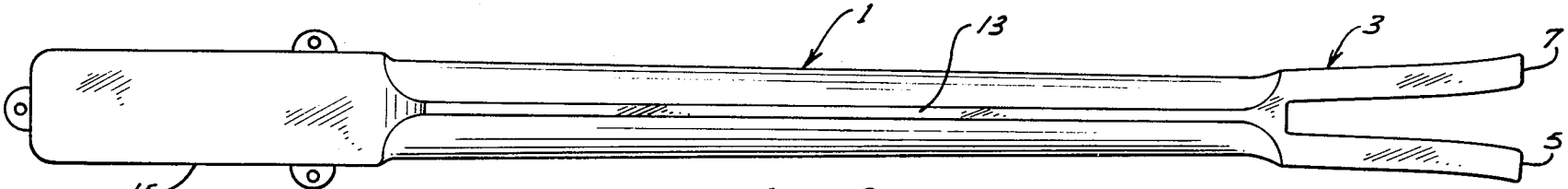
FIG. 3 is a bottom plan view of the structure.
Figure 4:
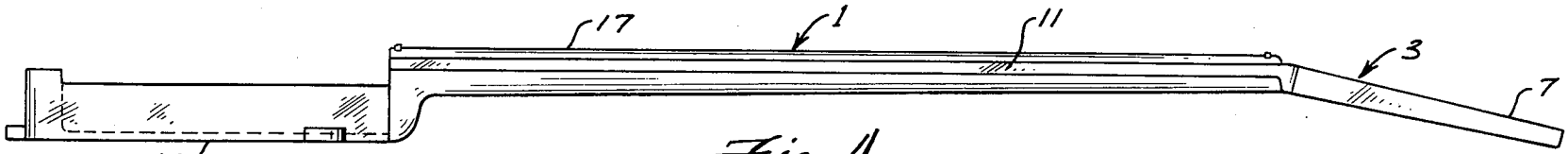
FIG. 4 is a side elevation view of the structure.

The top, bottom and side views of the neck and head structure constructed in accordance with the invention are shown in FIGS. 2, 3 and 4 and disclose the outline appearance of the neck structure 1 to be somewhat conventional. The head 3 is bifurcated, and the space between the bifurcated portions 5 and 7 reduces the weight of the instrument.

An elongated T-shaped reinforcing member 9 comprising a top crosspiece 11 and depending leg 13 extends throughout the length of neck structure 1. Head 3 is integral with reinforcing member 9 at one end and the soundbox structure 15 is integrally formed at the other end for fastening to the body of the instrument. A fingerboard member 17 is attached to the top of crosspiece 11 and inserts 19, 21 are attached on either side of the depending leg 13 throughout the length of neck 1 to complete the generally semicircular cross-section and produce a neck structure which may be gripped comfortably by hand.

The composite structure of this invention is stronger and lighter than those structures previously known. The reinforcing member 9 is formed of aluminum which is stress-relieved. The side inserts are glued in position and the neck surface is finished with a non-conductive coating 20 as a precaution against electrical shock.

What is claimed is:

1. In a stringed instrument of the type in which a plurality of strings are suspended over and along a fingerboard, the combination comprising a fingerboard, a pair of wood or plastic inserts each having a curved outer surface, a reinforced neck including a crosspiece and leg combined to form a T-shaped member formed of forged aluminum and having a recess on each side of said T-shaped member wherein said fingerboard rests on said crosspiece and said inserts are respectively embraced totally within said recesses between said crosspiece and said leg to form a neck wherein said curved outer surfaces of said inserts are flush with the ends of said T-shaped member to form a generally smooth semicircular neck cross section, the ends of said T-shaped member being exposed to enhance the sound produced, and the entire side walls of said inserts engaging said T-shaped member to prevent warpage or twisting of said inserts, and a forked head forming an integral extension of said T-shaped member and formed of said forged aluminum, said integral head and said T-shaped member having substantially the same height, and said aluminum head being totally exposed, whereby weight and distortion of said neck and head are reduced and machining and playing characteristics are enhanced.

2. In the stringed instrument of claim 1, said inserts having a non-conductive coating on their curved outer surfaces.

* * * * *